US006008731A

United States Patent [19]

Capan

[11] Patent Number: 6,008,731

[45] Date of Patent: Dec. 28, 1999

[54] DETECTOR FOR SENSING MOTION AND DIRECTION OF A RAILWAY VEHICLE

[75] Inventor: Ronald R. Capan, Pittsburgh, Pa.

[73] Assignee: Union Switch & Signal, Inc., Pittsburgh, Pa.

[21] Appl. No.: 08/902,816

[22] Filed: Jul. 30, 1997

[51] Int. Cl.[6] ..... G08B 21/00

[52] U.S. Cl. ..... 340/665; 340/669; 340/683; 340/870.3; 310/318; 246/167 R; 246/182 R; 73/651

[58] Field of Search ..... 340/665, 669, 340/683, 870.3; 310/318, 338, 339, 319; 246/167 R, 182 R, 169 R, 218, 270 R, 359; 73/651

[56] References Cited

U.S. PATENT DOCUMENTS

| | | | |
|---|---|---|---|
| 4,561,057 | 12/1985 | Haley, Jr. et al. | 364/436 |
| 4,752,053 | 6/1988 | Boetzkes | 246/167 R |
| 5,003,824 | 4/1991 | Fukada et al. | 73/651 |
| 5,016,840 | 5/1991 | Bezos | 246/187 R |
| 5,084,696 | 1/1992 | Guscott et al. | 340/541 |
| 5,235,472 | 8/1993 | Smith | 360/60 |
| 5,374,015 | 12/1994 | Bezos et al. | 246/169 R |
| 5,376,925 | 12/1994 | Crisafulli et al. | 340/665 |
| 5,452,612 | 9/1995 | Smith et al. | 73/514.34 |
| 5,507,457 | 4/1996 | Kull | 246/169 F |
| 5,736,923 | 4/1998 | Saab | 340/429 |

*Primary Examiner*—Benjamin C. Lee
*Attorney, Agent, or Firm*—David V. Radack; Eckert Seamans Cherin & Mellott, LLC

[57] ABSTRACT

A motion detector for detecting movement of a rail based vehicle and the direction of that movement is provided. The motion detector can be integral with or attachable to an end-of-train unit and can include a single axis accelerometer mounted at an angle from the rails for detecting acceleration in both the lateral and vertical directions. A systems controller, which can include an analyzer, can be provided to receive and analyze output from the accelerometer to determine a motion state and a direction. A power controller can be provided for supplying power to the accelerometer on an intermittent basis to conserve power. A calibration unit can be provided to both initially calibrate and to subsequently recalibrate the accelerometer after a stopped motion state is detected. Additionally, an input/output port and an output driver for conditioning the signal for output to the end-of-train unit can be provided.

11 Claims, 4 Drawing Sheets

DETECTOR FOR SENSING MOTION AND DIRECTION OF A RAILWAY VEHICLE

BACKGROUND OF THE INVENTION

1. Field of the Invention

The invention relates generally to motion detectors, and more particularly to a motion and direction detector of a railway vehicle and in some applications on an end-of-train (EOT) railroad telemetry system.

2. Description of the Prior Art

In railway systems such as those employing locomotive drawn trains, it can sometimes be difficult for the engineer or other operator to reliably be apprised of the state of motion of one or more vehicles that are located remotely from him. For example, when starting a train from a stop position it can in some operations be particularly difficult for the train driver to know when the driving force of the locomotive has propagated through the interconnected cars and accelerated the last vehicle into motion. Conversely, when coming to a stop, it is difficult for the driver to know when the last car has been decelerated to a standstill. Knowledge of these conditions of motion of the last vehicle can be extremely useful to the driver in controlling operation of the train.

EOT signaling and monitoring equipment is now widely used in place of cabooses, to meet operating and safety requirements of railroads. The information monitored by the EOT unit typically includes air pressure of the brake pipe, battery condition, marker, light operation, and train movement. This information can be transmitted to the crew in the locomotive by a battery powered telemetry transmitter. In addition, the EOT unit typically includes a marker light mounted at a specific height above the track and having a well defined beam pattern.

The early EOT telemetry systems were one-way systems; that is, data was periodically transmitted from the EOT unit to Head of Train (HOT) unit in the locomotive where the information was displayed. More recently, two-way systems have been introduced wherein radio transmissions are also made by the HOT unit to the EOT unit.

With the continuing development of EOT units for use in two-way railroad telemetry systems, one goal has been to improve the functionality of the existing motion sensor, especially when operated on a smooth rail. In addition, some older types of sensors do not report direction of motion.

Many contemporary motion and direction detectors for EOT units commonly employ a piezoelectric film as the sensing element. Examples of such contemporary motion and direction sensors are disclosed in U.S. Pat. No. 5,376,925 to Crisafulli et al., U.S. Pat. No. 5,003,824 to Fukada et al. and U.S. Pat. No. 4,752,053 to Boetzkes. Crisafulli, Boetzkes and Fukada each disclose devices which have two sensors utilizing piezoelectric film. One piezoelectric sensor for detecting motion, and a separate piezoelectric sensor for detecting direction.

Although piezoelectric film has been the medium of choice in many contemporary sensors, there can be disadvantages associated with the use of piezoelectric films especially environmental conditions such as shock, breakage, susceptibility to EMI, and temperature. Additionally, the piezoelectric sensors of contemporary motion detectors can also take hours to calibrate.

Furthermore, contemporary motion detectors typically may keep all motion and direction monitoring electronics powered and operating continuously. This may force the designer to use very high impedance sensors and processing electronics which can in some designs lead to the problems of sensitivity to temperature and humidity and susceptibility to EMI. Complex and time consuming algorithms can then be required to account for the errors introduced by these conditions.

Moreover, motion and direction detecting devices disclosed in each of the above patents employ separate piezoelectric sensors for determining motion and direction.

SUMMARY OF THE INVENTION

According to the present invention a motion and direction detector for an EOT unit to be attached to a rail based vehicle is provided having a single accelerometer which can detect acceleration in both lateral and vertical directions, is easily calibrated, and does not need to be maintained in a continuously powered state.

A motion detector having features of the present invention can include a single axis accelerometer mounted at an angle, preferably upwards from the rails, so that the resultant signal will have components in both the lateral and vertical directions. The single axis accelerometer can be connected to a systems controller, which can include an analyzer, for receiving motion signals from the accelerometer and analyzing those signals to determine both the motion state and direction of the rail vehicle. The motion detector can be an integral part of an EOT unit, or may be produced as an individual module which can be mounted on the EOT unit. Where the motion detector is produced as a stand alone module, the module can include a printed circuit board having the accelerometer and systems controller, along with the necessary components and circuitry mounted on the PC board. The PC board can be mounted on the angled surface of a frame member which is attachable to an EOT unit. A cover can also be provided to enclose and protect the operative components and circuitry in the circuit board. The PC board can additionally have an input/output port for connecting the module to the EOT unit which transmits the information to the HOT unit.

The motion detector can be powered by the battery in the EOT unit and can have a power controller for regulating the power supplied to the accelerometer. The systems controller can actuate the power controller for imposing a power conservation mode on the accelerometer wherein power is provided only on an intermittent basis thereby prolonging battery life. This power conservation mode can preferably be initiated by the systems controller after the analyzer, which can be a function carried out by the systems controller, detects that the rail vehicle is moving, and in what direction. While the rail vehicle is moving the power conservation mode can be maintained in order to conserve battery power by cycling the accelerometer on and off. The power conservation mode can preferably be employed until such time as the analyzer determines that the rail vehicle has stopped moving. In some embodiments, when a stopped motion state is detected the systems controller can preferably maintain the accelerometer in a continuously powered state until motion, and direction, of the rail vehicle is again detected.

Other details, objects, and advantages of the invention will become apparent from the following description and the accompanying drawings of certain preferred embodiments thereof.

BRIEF DESCRIPTION OF THE DRAWING FIGURES

In the accompanying drawing figures certain preferred embodiments of the invention are illustrated in which.

DETAILED DESCRIPTION OF CERTAIN EMBODIMENTS

Figure 1:
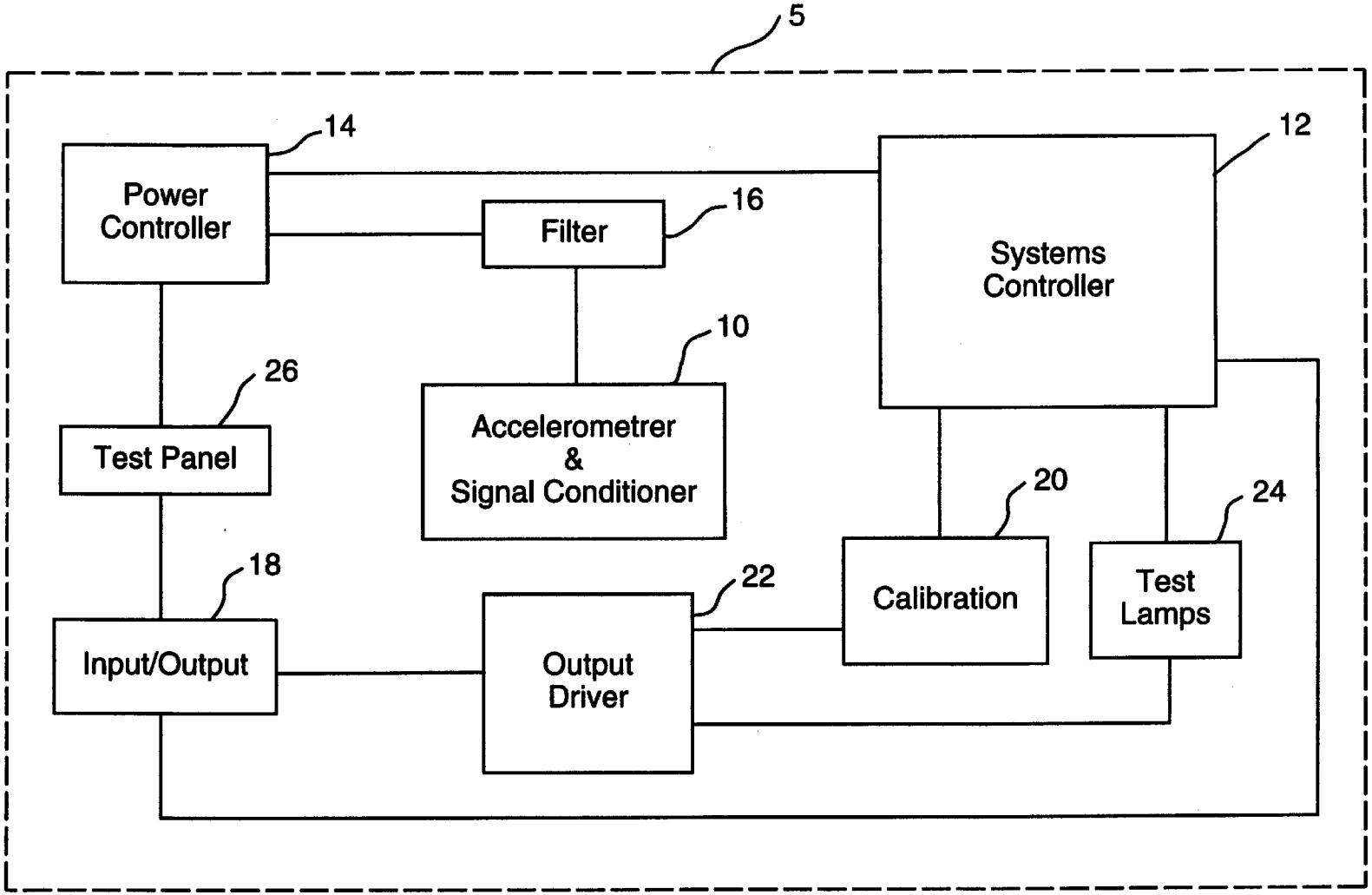
FIG. 1 is an operational block diagram for an embodiment of the invention.

Referring now to the drawing figures wherein like reference numbers refer to similar parts throughout the several views, and particularly to FIG. 1, there is shown in block diagram form certain components of a motion detector 5 having features of the present invention.

The motion detector 5 can include an accelerometer 10 for generating signals corresponding to acceleration. A systems controller 12, which can include an analyzer, can be provided to receive and analyze the signals from the accelerometer 10 and to control the overall operation of the motion detector 5. The motion detector 5 can also have a power controller 14, a filter 16, an input/output port 18, a calibration unit 20, an output driver 22, test lamps 24, and a test panel 26.

Figure 3:
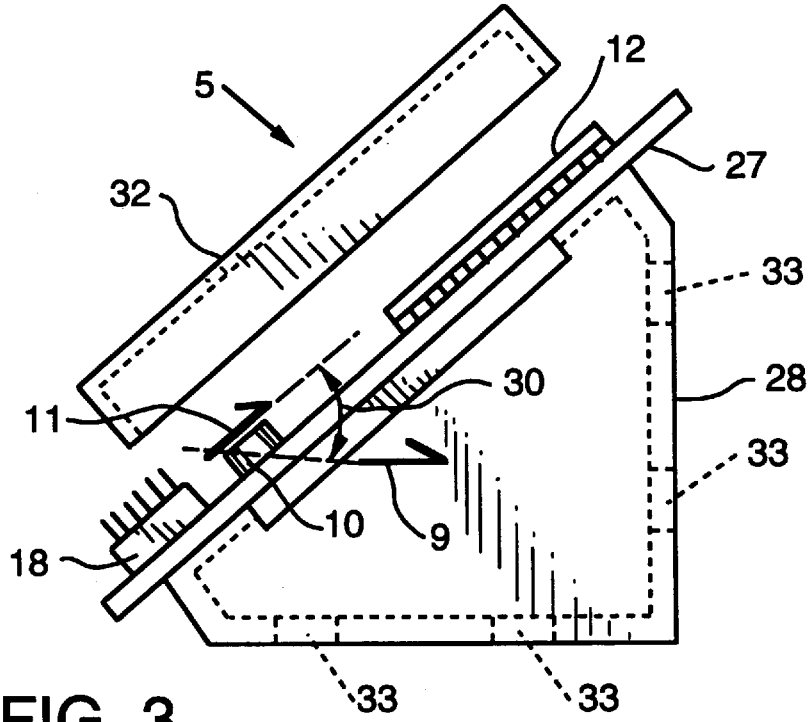
FIG. 3 is a side view of the embodiment shown in FIG. 2.

The single axis accelerometer 10 can be mounted at an angle from a plane formed by the rails, as indicated by reference number 30 in FIG. 3. The accelerometer 10 can preferably be positioned such that the axis of sensitivity, represented by vector 11, is in a plane generally parallel to the longitudinal axes of the rails, represented by vector 9, and angled upwards from the plane formed by the rails. The angle can be, for example, 40 degrees whereby the accelerometer has more sensitivity to accelerations along an axis generally parallel to the longitudinal axis, vector 9, of the rails but is also sensitive to accelerations normal to the plane formed by the rails. A single sensor can therefore be employed to detect motion along two distinct axes which can reduce cost, power consumption, space, and weight of the motion and direction detecting device.

Detecting acceleration in the vertical direction can be important in helping to more accurately determine when the rail vehicle is moving. Since a constant speed in the lateral direction would result in a zero acceleration reading from the accelerometer 10, detecting motion in the vertical direction can provide additional information about the motion state of the rail vehicle which can help determine if the rail vehicle is moving. The landscape over which the rail vehicle travels and the suspension of the rail vehicle typically cause accelerations in the vertical direction (rock and roll) which can be detected by the accelerometer 10 due to the angled orientation. Signal components from these motions can be monitored to permit a more accurate determination of the motion state of the rail vehicle.

In some embodiments, the motion detector 5 can preferably be mounted such that the central axis of the accelerometer 10 is not aligned with the centerline of the rail vehicle so that side to side rocking movements of the rail vehicle, which cause vertical accelerations, are more pronounced with respect to the accelerometer.

Power to operate the motion detector 5 is supplied by the power source of the EOT unit, which is usually a battery. Since both the EOT systems and the motion detector are powered by the same battery it can be very important to conserve battery power. The power supplied to the accelerometer 10 can regulated by the power controller 14 to conserve battery power. To conserve power the power controller 14 can restrict the supply of power to the accelerometer 10 in response to a number of inputs, such as a manual input, an input from the EOT unit, or inputs from the systems controller 12. For example, the power controller 14 can be designed to cut-off power to the accelerometer when an input indicates one of several conditions, such as the EOT unit being disconnected from the rail vehicle or the motion detector lying on its side or in some orientation which would corrupt the output. Additionally, the power controller 14 can be responsive to input from the systems controller 12. The filter 16 can be provided between the power controller 14 and the accelerometer 10 to remove interference such as RFI, and condition the power before it is received by the accelerometer 10.

The systems controller 12 can include an analyzer which receives and analyzes the output from the accelerometer 10 to determine the motion state and direction of the rail vehicle. The systems controller 12 can be a microprocessor having either a programmable memory or a preprogrammed read only memory for analyzing the output from the accelerometer 10. The systems controller 12 can provide additional functions by being programmed to control the power controller 14 to regulate the power provided to the accelerometer 10. In certain conditions of operation of the motion detector 5, the systems controller 12 can impose a power conservation mode during which the power controller 14 will provide power to the accelerometer 10 only on an intermittent basis. The power conservation mode can be initiated to conserve the battery power in the EOT unit while the rail vehicle is moving. In certain embodiments, the power conservation mode is preferably maintained only while the rail vehicle is moving (i.e. until the rail vehicle stops) at which time the accelerometer 10 can thereafter be maintained in a fully energized state in order to detect when the rail vehicle resumes movement and in what direction such movement occurs. During the power conservation mode the accelerometer can be cycled on for a certain duration and off for a certain duration to provide a desirable average power consumption. In certain application the on time can be from about 80–86 milliseconds and the off time can be from about 980–990 milliseconds so the power consumption can be reduced to an acceptable level such as can be provided by the battery in the EOT unit over the duration of the travel of the rail vehicle.

A calibration unit 20 can be provided for initially calibrating the accelerometer 10. This can be done before shipping or when first installed on the rail based vehicle. Additionally, the calibration unit 20 can be employed to recalibrate the accelerometer 10 after it is subsequently determined that the rail vehicle has stopped moving. Upon initial installation of the motion detector 5, the calibration unit 20 presets an initial reference signal from the accelerometer 10. Preferably, the accelerometer 10 operates at a range of 0 to 5 volts and can detect both positive and negative acceleration. The reference signal is preferably preset at 2.5 volts, i.e., the midpoint of the operating range. Output from the accelerometer 10 above 2.5 volts, plus a predetermined threshold, can be indicative of forward acceleration. Conversely, output from the accelerometer 10 below 2.5 volts (minus a preset threshold) can be indicative of acceleration in the reverse direction. For example, an output of 2.4 volts to 2.6 volts can indicate no movement, whereas an output of 2.7 volts or greater can be indicative of forward movement, while an output of 2.3 volts or less can indicate movement backwards.

When it has been determined that a moving rail vehicle has come to a stop, the systems controller 12 can cause the calibration unit 20 to recalibrate the accelerometer 10. The calibration unit 20 discards the old reference signal and replaces it with a new reference signal indicative of the present voltage output of the accelerometer 10 which corresponds to the stopped motion state. Since the rail vehicle may conceivably stop on a sloping section of track, the accelerometer 10 could be generating a signal that would otherwise indicate acceleration, but is actually a signal having a gravitation component different from a purely horizontal stationary rail vehicle. Thus, recalibrating the accelerometer 10 can be important in reducing error when the rail vehicle moves, stops, and then moves again. In rail vehicles, the slope is usually limited to a maximum of ±5% grade, thus the recalibration can also be limited.

The output driver 22 receives output indicative of motion and direction from the systems controller 12 and conditions that output for delivery to the EOT unit, via the input/output port 18, for transmission to the HOT unit, or for use by the EOT unit.

Additionally, test lamps 24 and a test panel 26 can be provided for testing the proper functioning of the motion detector 5. The test lamps 24, preferably LEDs, can be provided between the systems controller 12 and the output driver 22 for simple and convenient testing of the motion detector 5. The test panel 26 can be provided for testing the proper functioning of the power controller 14. The LEDs can be coded to show "FORWARD," "REVERSE," "STOP" and other values.

Figure 2:
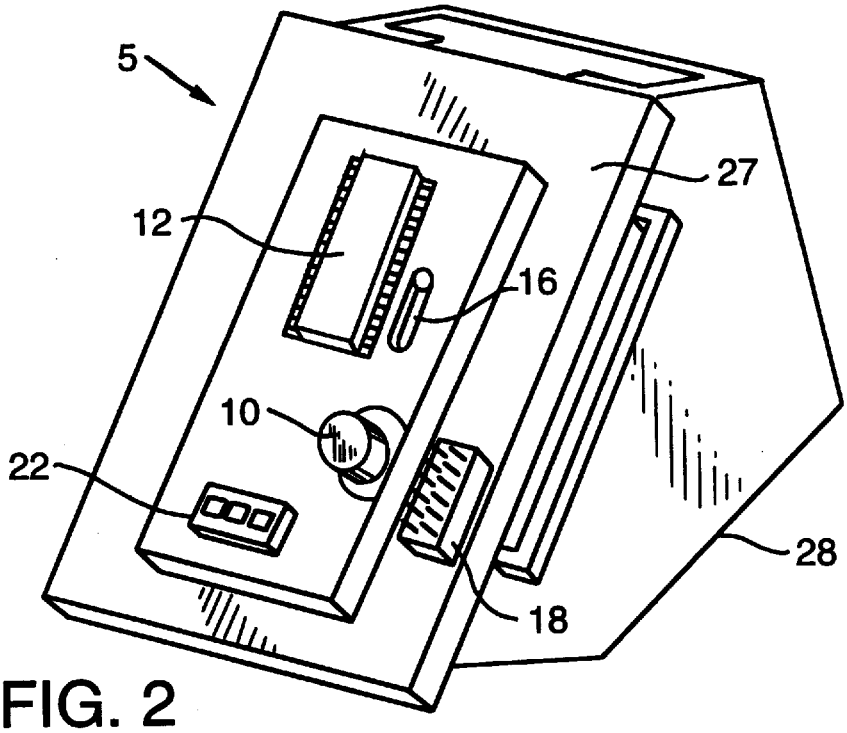
FIG. 2 is a perspective view of an embodiment of the invention.

Referring now to FIGS. 2 and 3, there is shown a mechanical design for an embodiment of a motion detector 5 having features of the present invention. The motion detector 5 can be mounted on a printed circuit board 27 attached to an angled upper surface of a frame member or supporting structure 28.

Mounted on the circuit board 27 is a single axis accelerometer 10, a systems controller 12, a filter 16, an input/output port 18, and test lamps 24. The frame member 28 can have mounting holes or attachment mounts 33 for attachment to an end-of-train unit. Alternatively, studs, grooves, or other known attachment means for attaching the frame member to the end-of-train unit can be provided. A cover 32 can also be provided to enclose and protect the components and circuitry on the printed circuit board 27 as shown in FIG. 3.

The accelerometer 10 can preferably be mounted at an angle reference number 30, as shown in FIG. 3, so that accelerations of the rail vehicle in both the lateral and vertical directions can be detected while utilizing a single sensor. The angle 30 is preferably about 40 degrees upwards from the rails to provide more sensitivity in the lateral direction than a 45 degree angle would permit. Depending upon the application and the output of the sensor, the angle 30 can be chosen to provide an optimum signal for the desired application.

Figure 4:
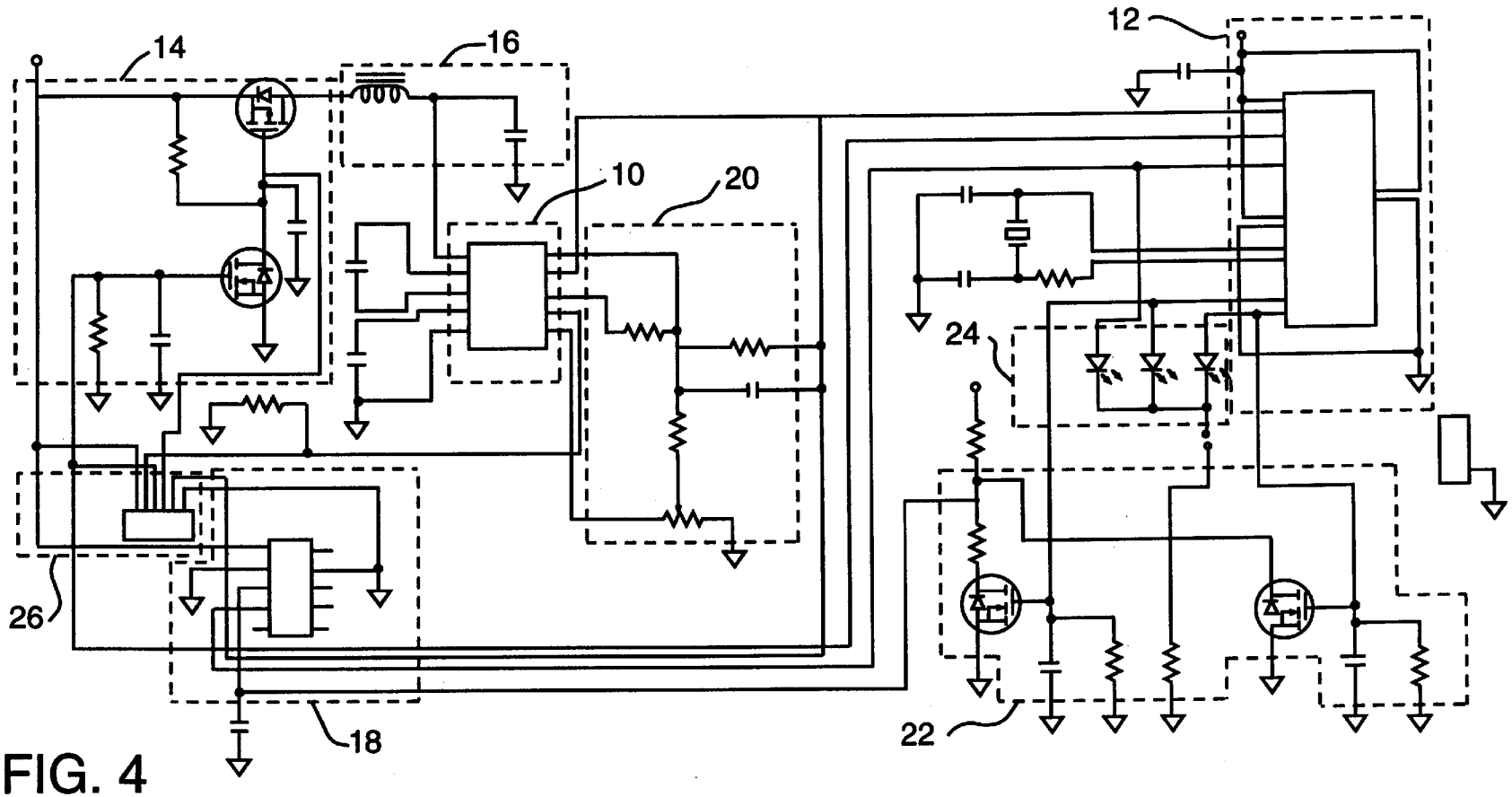
FIG. 4 is a circuit diagram for an embodiment of the invention.

FIG. 4 shows an embodiment of a circuit diagram for one embodiment of the invention. The circuit board 27 can have such components and circuitry in FIG. 4. Shown is a single axis accelerometer 10, a systems controller 12, which can include an analyzer, a power controller 14, a filter 16, an input/output port 18, a calibration unit 20, an output driver 22, test lamps 24, and a test panel 26.

The single axis accelerometer can preferably be a device supplied by ANALOG DEVICES™ such as the Model ADXLO5AH which can have an operating range from 0 to 5 volts and can sense positive and negative acceleration. This or a device utilizing micromachined silicon technology can be employed.

The systems controller 12 can be a microcontroller such as part number PIC16C74JW supplied by Microchip™ which can be programmed to analyze output signals from the accelerometer 10 in order to determine therefrom a motion state and a direction of the rail based vehicle. The systems controller 12 preferably also can be programmed to drive the power controller 14 for providing power intermittently to the accelerometer 10 when necessary to the conserve battery power of the EOT unit. The filter 16 can include a WB type choke and a capacitor to filter interference and condition the power signal before it is supplied to the accelerometer 10. The power controller 14 includes a first MOSFET (Q2) having a part number SI9435DY and a second MOSFET (Q1) having a part number VN0605T.

The test panel 24 can have LED's as shown. In a preferred embodiment, the LEDs are only powered if a test jumper is installed to activate them.

The input/output 18 provides an output signal to other equipment such as EOT controller or telemetry unit for sending the detected movement information to the head end of the train.

The test lamps 24 can include three LED's, two of which can be red and the third can be green. The LED's are used during factory calibration and for future operational verification. In operation, the accelerometer 10 is initially calibrated and then the motion detector 5 can be tapped from the front, the back, and from the side. Based on the direction of the tapping, a different sequence of LED's should light up indicating motion and the proper direction of the detected motion The output driver 22, can include a pair of MOSFETs (Q3, Q4) such as the part number VN0605T.

Although the motion detector is shown in FIGS. 1 and 2 as an independent device, the circuit board 14 containing the requisite operational components and circuitry can alternatively be mounted directly in the end-of-train unit. Moreover, the requisite operation components and circuitry could be mounted directly to a general purpose circuit board provided in the end-of-train unit. Thus, it is to be understood that neither a frame member 16 nor an individual circuit board 14 are necessarily required for the function of the detector. In either case however, the accelerometer is preferably mounted at an angle so that a single accelerometer can sense movement in both the lateral and vertical directions.

Furthermore, the circuit board 27 can be mounted on a floating medium to help attenuate the detection of high amplitude/high frequency motion. For example, there can be a pivotal mount in the center of the board and the corner of the board could be weighted, resting on springs or both. Also, the board can be centrally pivoting on a spring to which is attached and likewise the corners of the board, or edges, can be weighted. Additionally, the entire board can be laid on a very soft spring material which spans the entire board dimension and the board can be weighted accordingly. Such mounting includes the frame 28 being made from an elastomeric or resilient material, or having a portion of the frame 28 being of a resilient or elastomeric material. Shock absorbing mounting stand-offs can be used as mounting attachments 33.

Figure 5:
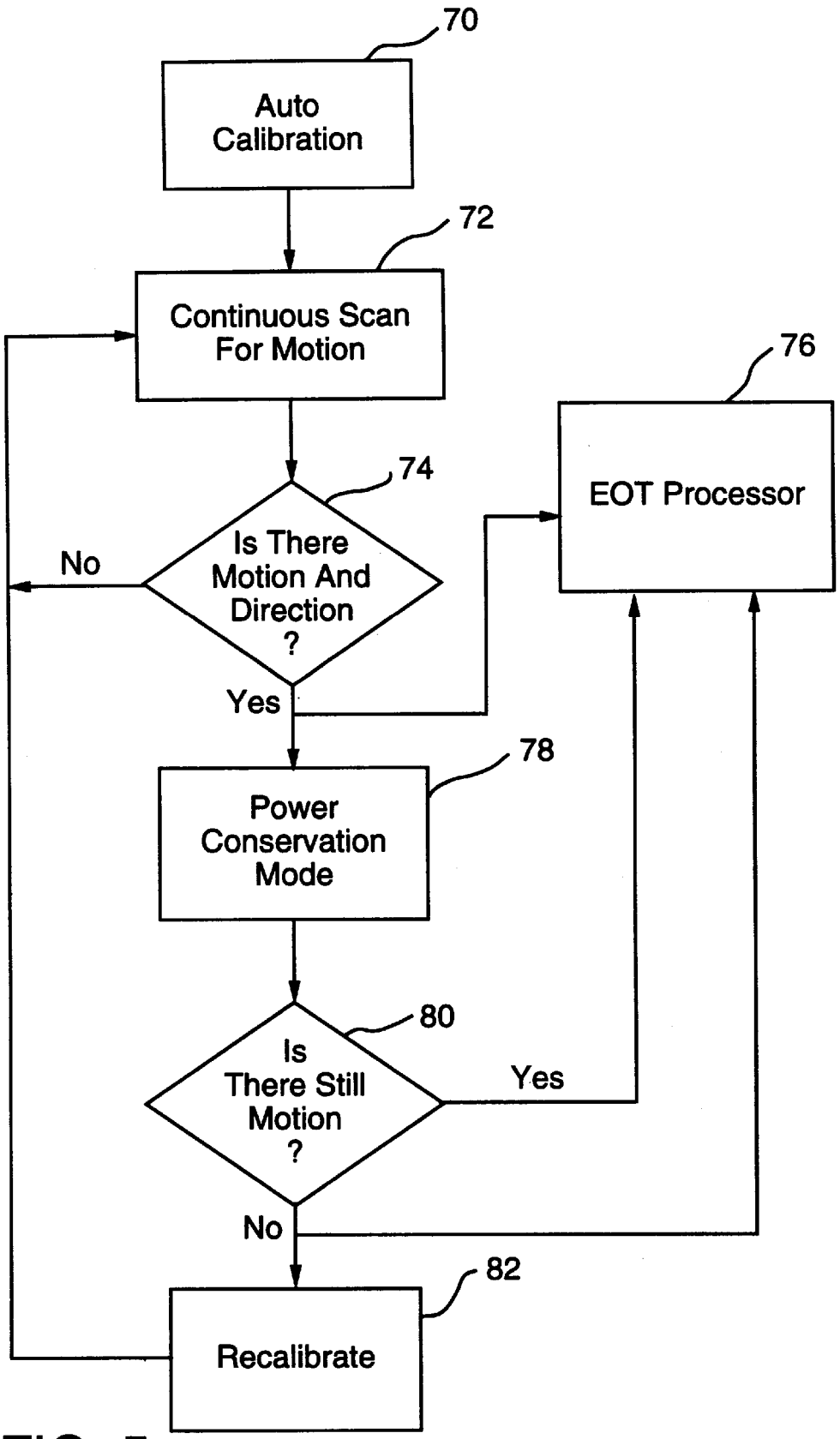
FIG. 5 is an operational flow chart for an embodiment of the invention.

Referring now to FIG. 5, wherein a simplified operational flow chart of the motion detector 5 of one embodiment of the present invention is illustrated. Once connected to the EOT unit and attached to the rail vehicle, the motion detector 5 undergoes an initial auto calibration, block 70. During auto calibration the output of the motion detector 5 is preset at a reference voltage. The reference voltage can be for example 2.5 volts, the midpoint of the operating range of the accelerometer, which for example would be 0 to 5 volts. The preset voltage is preferably the midpoint of whatever the operating voltage of the accelerometer so that negative acceleration is indicated by an output of less than 2.5 volts and positive acceleration is indicated by an output of more than 2.5 volts. Acceleration can be determined when the deviation from the reference voltage is beyond a certain preset threshold. The threshold range can vary depending upon the application.

Initially the motion detector 5 is maintained in a fully powered state of continuous scan for motion, block 72, by the analyzer, which can be a function of the systems controller 12, to detect motion and direction, block 74. Motion is determined, block 74, when the output from the accelerometer exceeds the reference voltage by such preset threshold. For example, an output voltage exceeding 2.6 volts or below 2.4 volts indicates movement. The direction of the movement can be determined by the analyzer, block 74, from the polarity of the output. For, example an output voltage above 2.5 volts, plus the threshold, indicates forward movement while an output voltage below 2.5 volts, plus the threshold, indicates reverse direction. The EOT can then be notified of the motion and direction, block 76.

After movement and direction has been detected by the analyzer, block 74, a power conservation mode, block 78, may be imposed on the accelerometer 10. During the power conservation mode, block 78, power is supplied to the accelerometer 10 only on an intermittent basis. The quiescent power requirement of the accelerometer 10, about 10 milliamps, can be too high for the EOT application which is battery powered. Thus, the power conservation mode, block 78, can be imposed in some embodiments to conserve battery power and reduce the average power consumption to an acceptable level for the EOT application.

The power conservation mode, block 78, can be maintained wherein the accelerometer 10 can preferably be cycled, such as for example, "on" for 80–86 milliseconds and "off" for 980–990 milliseconds. Each time the accelerometer 10 is cycled on the output is evaluated by the analyzer, block 80, to determine whether the rail vehicle is still moving. As long as it is determined that the rail vehicle is still in motion the power conservation mode, block 78, can be maintained.

At block 80 the output signal from the accelerometer 10 is analyzed each time it is cycled. This is used to determine whether the rail vehicle is still moving or has stopped. A stopped motion state is indicated when the analyzer determines that the output from the accelerometer 10 has not deviated from the 2.5 volt reference signal beyond the preset threshold value for a certain predetermined period of time. The preset time period can preferably be from about 8 seconds to about 22 seconds.

During the time the accelerometer 10 is being cycled on and off and the rail vehicle is moving, the analyzer does not check for direction. The direction of the movement need only evaluated when the rail vehicle begins acceleration from an initially stopped motion state. Once the direction is evaluated, the analyzer need no longer checks for changes in direction because it is assumed that the rail vehicle cannot change directions without first coming to a stop. This is especially true for a train which has very large inertia and can not change directions rapidly. Thus, only the presence of motion need only be evaluated by the analyzer until such time as a stopped motion state is detected.

If the analyzer determines at block 80 that the output from the accelerometer 10 has not deviated from the reference voltage beyond the preset threshold for about 8 to 22 seconds the systems controller 12 notifies the EOT unit at block 74 that the rail vehicle has stopped. When the stopped motion state is detected at block 80, the power conservation mode, block 78, imposed on the accelerometer 10 can be disabled and the systems controller 12 thereafter can maintain the accelerometer 10 in a fully powered continuous scan status, block 70.

In some embodiments, at this point the accelerometer 10 can be recalibrated, block 82. The recalibration process can preferably involve discarding the initial preset reference signal and substituting therefore the value of the present output signal which is indicative of the stopped motion state. Thus, the new output of the accelerometer 10, indicative of the stopped motion, is substituted as the new reference signal. This embodiment is advantageous if the rail vehicle were to have stopped on a slope, which can have gravitational effects on the output of the accelerometer. Thus the analyzer, which can be a function of the systems controller 12, will not view the accelerometer 10 output as indicating movement unless the output exceeds beyond the new reference signal plus the preset threshold.

Once recalibrated, block 82, the accelerometer 10 is maintained in a fully powered status awaiting the detection of movement, at which point the process outlined above can be repeated.

While certain embodiments of the invention have been described in detail, it will be appreciated by those skilled in the art that various modification to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A motion detector for detecting movements of a vehicle supported on a pair of rails, said detector to be mounted on an end-of-train unit for attachment to said vehicle, said detector comprising:

a. a single axis accelerometer mounted at an angle from a plane formed by said pair of rails;

b. said accelerometer having a sensitivity to acceleration along an axis generally parallel to a longitudinal axis of said pair of rails;

c. said accelerometer also having a sensitivity to acceleration along an axis generally normal to said plane formed by said pair of rails;

d. said accelerometer generating a motion signal having components of acceleration corresponding to said parallel axis and said normal axis;

e. an analyzer receiving said components and determining therefrom at least one of a motion state and a direction, said motion state being one of stopped and moving;

f. said analyzer receiving a reference signal during a reference period, said reference signal corresponding to a stopped motion state;

g. said analyzer receiving at least one operational signal from said accelerometer during an operational period, said operational period occurring after said reference period, said components of said at least one operational signal having a polarity indicative of one of positive and negative acceleration;

h. said analyzer determining said direction from the polarity of said parallel component, said direction being one of forward and reverse;

i. a power controller operatively connected to said accelerometer for regulating the power provided thereto;

j. said power controller one of cycling said accelerometer by providing power to said accelerometer intermittently to conserve power and cutting off power to said accelerometer;

k. said power controller responsive to said analyzer; and l. said analyzer causes said power controller to cycle said accelerometer in response to said analyzer determining a moving motion state and a direction.

2. The motion detector of claim 1 wherein said analyzer ceases determining direction until a subsequent stopped motion state is determined.

3. The motion detector of claim 2 wherein said analyzer causes said power controller to cease said cycling in response to determining a subsequent stopped motion state and maintains said accelerometer in a fully powered state.

4. The motion detector of claim 3 wherein said analyzer is recalibrated during said stopped motion state by discarding said reference signal and substituting therefore a new reference signal received from said accelerometer, said new reference signal corresponding to said subsequent stopped motion state.

5. The motion detector of claim 1 wherein said accelerometer is cycled on for a shorter period of time and cycled off for a longer period of time to provide an acceptable average level of power consumption over the duration of the trip of the rail vehicle.

6. The motion detector of claim 5 wherein said accelerometer is cycled on for about 80 to 86 milliseconds and cycled off for about 980 to 990 milliseconds.

7. A method of detecting movements of a vehicle supported on a pair of rails, said vehicle having an inertial sensor, said method comprising the steps of:

a. sensing a motion signal indicative of acceleration along a single axis, said single axis angled from a plane formed by the pair of rails, said motion signal having a parallel component and a normal component, said parallel component generally parallel to a longitudinal axis of said pair of rails, said normal component generally normal to the plane formed by said pair of rails;

b. determining at least one of a motion state and a direction from said components, said motion state being one of stopped and moving;

c. sensing a reference signal during a reference period, said reference period corresponding to a stopped motion state;

d. sensing at least one operational signal during an operational period occurring after said reference period, said operational period corresponding to a moving motion state;

e. determining said motion state from a comparison of the components of said reference signal and said at least one operational signal;

f. intermittently sensing said at least one operational signal to provide a desirable average power consumption over a certain period of time corresponding to a distance traveled by the rail vehicle; and g. initiating said intermittently sensing in response to determining a moving motion state.

8. The method of claim 7 further comprising the step of ceasing said intermittently sensing in response to determining a subsequent stopped motion state.

9. The method of claim 8 further comprising the step of recalibrating said inertial sensor when said subsequent stopped motion state is determined.

10. The method of claim 9 wherein said recalibrating comprises the steps of:

a. discarding said reference signal; and b. sensing a new reference signal corresponding to said subsequent stopped motion state.

11. The method of claim 7 further comprising angling said single axis about 40 degrees upwards from the plane formed by the pair of rails.

* * * * *